United States Patent [19]

Alverson et al.

[11] 4,013,853

[45] Mar. 22, 1977

[54] MULTI-PHASE COMPRESSED-GAS CIRCUIT-BREAKER CONSTRUCTION

[75] Inventors: Thomas E. Alverson, Brookfield, Ohio; Otto H. Soles, North Huntingdon, Pa.; Melvyn D. Hopkins, Pittsburgh, Pa.; Charles E. LeRow, Jr., Jeannette, Pa.

[73] Assignee: Westinghouse Electric Corporation, Pittsburgh, Pa.

[22] Filed: Nov. 27, 1974

[21] Appl. No.: 527,930

[52] U.S. Cl. ..... 200/148 B; 200/148 R

[51] Int. Cl.[2] ..... H01H 33/54

[58] Field of Search ..... 200/148 R, 148 B, 148 D, 200/148 E, 148 G, 148 H; 317/103

[56] References Cited

UNITED STATES PATENTS

| | | | |
|---|---|---|---|
| 2,748,226 | 5/1956 | MacNeill et al. | 200/148 |
| 2,999,143 | 9/1961 | Baker et al. | 200/148 D |
| 3,167,630 | 1/1965 | Alderman et al. | 200/148 D X |
| 3,566,062 | 2/1971 | Meier et al. | 200/148 E |
| 3,688,061 | 8/1972 | Kane et al. | 200/148 R |
| 3,863,041 | 1/1975 | Rostron et al. | 200/148 R X |
| 3,864,534 | 2/1975 | Goodwin, Jr. et al. | 200/148 D X |
| 3,941,963 | 3/1976 | Sasaki et al. | 200/148 G X |

*Primary Examiner*—James R. Scott
*Attorney, Agent, or Firm*—W. R. Crout

[57] ABSTRACT

An improved multi-phase compressed-gas circuit-breaker installation is provided having the three or more circuit-breaker assemblies mounted upon a horizontally-extending rigid frame structure, with the high-pressure and low-pressure gas-reservoir tanks disposed close to the ground, and having the circuit-breaker assemblies extending upwardly in spaced lateral horizontal relationship. Pressurized pipes, or conduits connect to the circuit-breaker assemblies, the pressurized pipes containing, of course, the internal high-voltage power-conductors at the centers of the pressurized pipes, as well known by those skilled in the high-voltage power-transmission art of the pressurized gas-insulated type.

Longitudinally-extending contact-operating linkage is provided lengthwise along the supporting frame structure, in an easily accessible location, and the control compartments and gas-compressor units are disposed in an advantageous relationship and location with regard to the gas-storage tanks, which leads to easy servicing and maintenance.

2 Claims, 11 Drawing Figures

CLOSED POSITION

CLOSED POSITION

OPEN POSITION
34
65
"C"
51
1
TO OPEN
37
64
TO CLOSE
31
SULFUR-
HEXAFLUORIDE
SF6 GAS
(FOR EXAMPLE)
22
19
19
"A"
20
20
"X"
23
23
HIGH PRESSURE
AT ALL TIMES
SAY 240 P.S.I.G.
(FOR EXAMPLE)
13
C
52
38
"C"
"A"
54

MULTI-PHASE COMPRESSED-GAS CIRCUIT-BREAKER CONSTRUCTION

CROSS-REFERENCES TO RELATED APPLICATIONS

Reference may be had to United States patent application filed Nov. 11, 1974 Ser. No. 522,960 by Ronald W. Crookston et al and to United States patent application filed Nov. 27, 1974 Ser. No. 527,929. Also, reference may be had to United States patent application filed Nov. 27, 1974 Ser. No. 527,931 by Richard E. Kane and Charles LeRow relating to the same general type of gas-insulated equipment, all of the aforesaid applications being assigned to the assignee of the instant application.

BRIEF SUMMARY OF THE INVENTION

In accordance with the present invention, an improved multi-phase gas-type circuit-breaker installation is provided, having upstanding interrupter assemblies spaced laterally apart, and connected to pressurized power-conducting grounded pipes, or conduits carrying high-voltage power conductors interiorly therein. The circuit-breaker assemblies are actuated by compressed gas, such as sulfur-hexafluoride ($SF_6$) gas, for example, and according to one aspect of the present invention, the horizontal mechanical linkage simultaneously actuates control-valve structures in the high-voltage operators, which, through piston action, effect opening and closing motion of the main movable power-contacts within the individual circuit-breaker modules, or units.

The location of the high-pressure and low-pressure gas-reservoir tanks, and the control-cabinet and gas-return-lines to the low-pressure gas-reservoir tank are so arranged as to permit easy access for servicing and maintenance. Orientation of the various mechanical mechanism components are arranged to have a pleasing appearance. The low-pressure gas-reservoir tank is, preferably, mounted on one side of the breaker installation, along with the gas-compressor and control cabinet. The arrangement blends these components so as to give an overall esthetic touch of compactness and easy maintenance.

The location of the low-pressure gas-reservoir tank can be varied to allow for an additional cabinet for control, or for some other function, if desired, to be mounted above or below or between the gas-reservoir tanks.

The I-beam legs have been oriented to present maximum strength for the circuit-breaker installation in the crosswise, or transverse direction. The arrangement of the I-beam legs allows for increased strength crosswise with no bracing, and presents a pleasing flat appearance or profile for the breaker side view. A unique mechanism-lever rod-linkage arrangement is employed to effect simultaneous operation of the several control-valve structures within the individual circuit-interrupter modules.

DESCRIPTION OF THE PREFERRED EMBODIMENT

Figure 2:
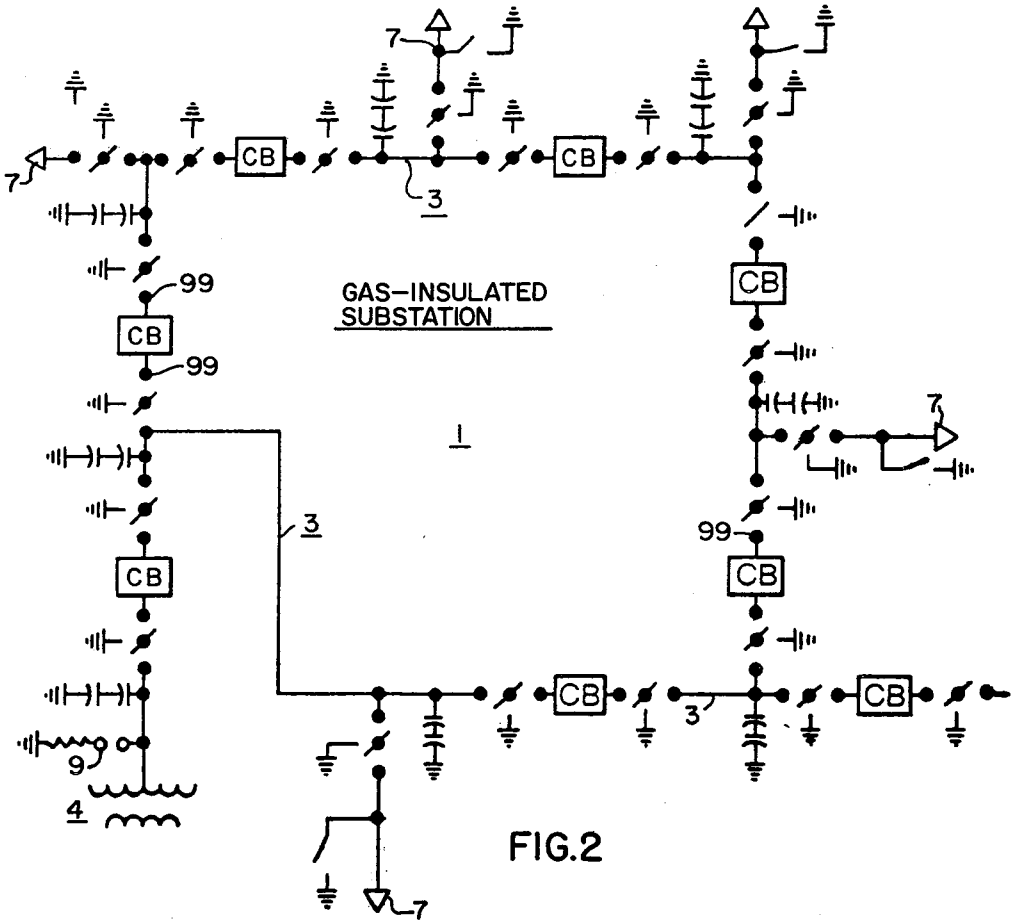
FIG. 2 is a one-line circuit diagram of the substation structure of FIG. 1 to indicate the circuit connections therefor.
Figure 1:
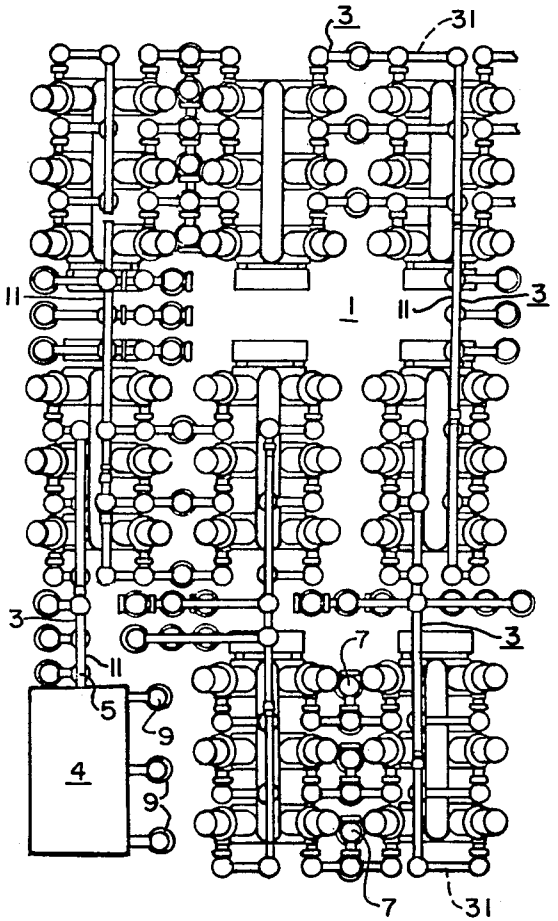
FIG. 1 is a plan diagrammatic view of a gas-insulated power substation showing, generally, the arrangement of circuit-breakers, power-transformers and the interconnecting gas-insulated grounded pressurized pipe structure.

The present invention has particular application to a line of equipment 1 involving gas-insulated substations having gas-insulated components, and somewhat diagrammatically illustrated in FIGS. 1 and 2 of the drawings.

FIG. 2 is a one-line diagram of the equipment 1 illustrated in FIG. 1. It will be noted, from a consideration of FIGS. 1 and 2, that the high-voltage equipment 1 is arranged so that both the space required, and the total length of the gas-insulated bus 3 is minimized. The power transformer 4 is located on an outside corner of the station, preferably, so that it can be easily removed. The gas-insulated bus 3 is attached directly to the transformer-bushing 5 minimizing area and height required. The location of the cable pothead 7 is flexible. In the gas-insulated system 1, as illustrated in FIGS. 1 and 2, it is chosen to minimize the length of the $SF_6$ bus 3. If a lightning arrester 9 is located at each pothead 7, an arrester 9 is not required at the power-transformer 4.

It will be noted that the gas-insulated system 1 of FIG. 1 can be connected to overhead lines. However, the air clearances, required by incoming power lines, will somewhat enlarge the total area required by the system 1, and will require additional $SF_6$ bus 3.

The gas-insulated transmission system 1, illustrated in FIG. 1, is a line of equipment, which will significantly reduce the space required by the high-voltage side of substations rated 115 KV through 345 KV. The space reduction is accomplished by replacing the open bus and airterminal bushings, commonly used, with gas-insulated bus 3 filled with sulfur-hexafluoride ($SF_6$) gas 31, for example at 45 p.s.i.g. (at 70° F), and moving the component parts of the electrical equipment as close together as possible.

The use of gas-insulated transmission systems 1 offers many advantages. The use of the system 1 offers several advantages to the utility user, some of these are:

1. Significant reduction in space requirements both in land area and overall height.
2. Added system reliability by eliminating the possibility of phase-to-phase faults, lightning strokes within the system 1, or contamination of the environment.

3. Reduced maintenance because the closed system 1 is isolated from its environment.
4. Added personnel safety because all live parts are covered by grounded shields.
5. The modular approach was chosen because it could provide the utility user with lower installation costs when compared with conventional or other gas-insulated systems.
6. The system 1 can be overbuilt to permit multiple use of the land.

Generally, the equipment 1 includes a plurality of bus assemblies 3 determined by the length that can generally be shipped. The typical bus length 3 will be, for example, 40 feet, and may consist of two 20-feet lengths, with an epoxy spacer (not shown) in each length. The ends of the bus 3 can be connected to additional lengths of bus 3, or any functional member of the system 1. Expansion joints are located in each 20-foot bus-section 3 to absorb the maximum of 0.4 inches of expansion expected. As stated, sulfur-hexafluoride ($SF_6$) gas 31 at 45 p.s.i.g., for example, fills both the sheath 11 and the bus conductor 3, and is free to move throughout the entire bus. The 45 p.s.i.g. $SF_6$ gas pressure provides approximately the highest dielectric strength possible down to −40° C without liquefaction, eliminating the need for auxiliary heat. High-pressure $SF_6$ gas, however, does require a heat input at low ambient temperatures.

Figure 3:
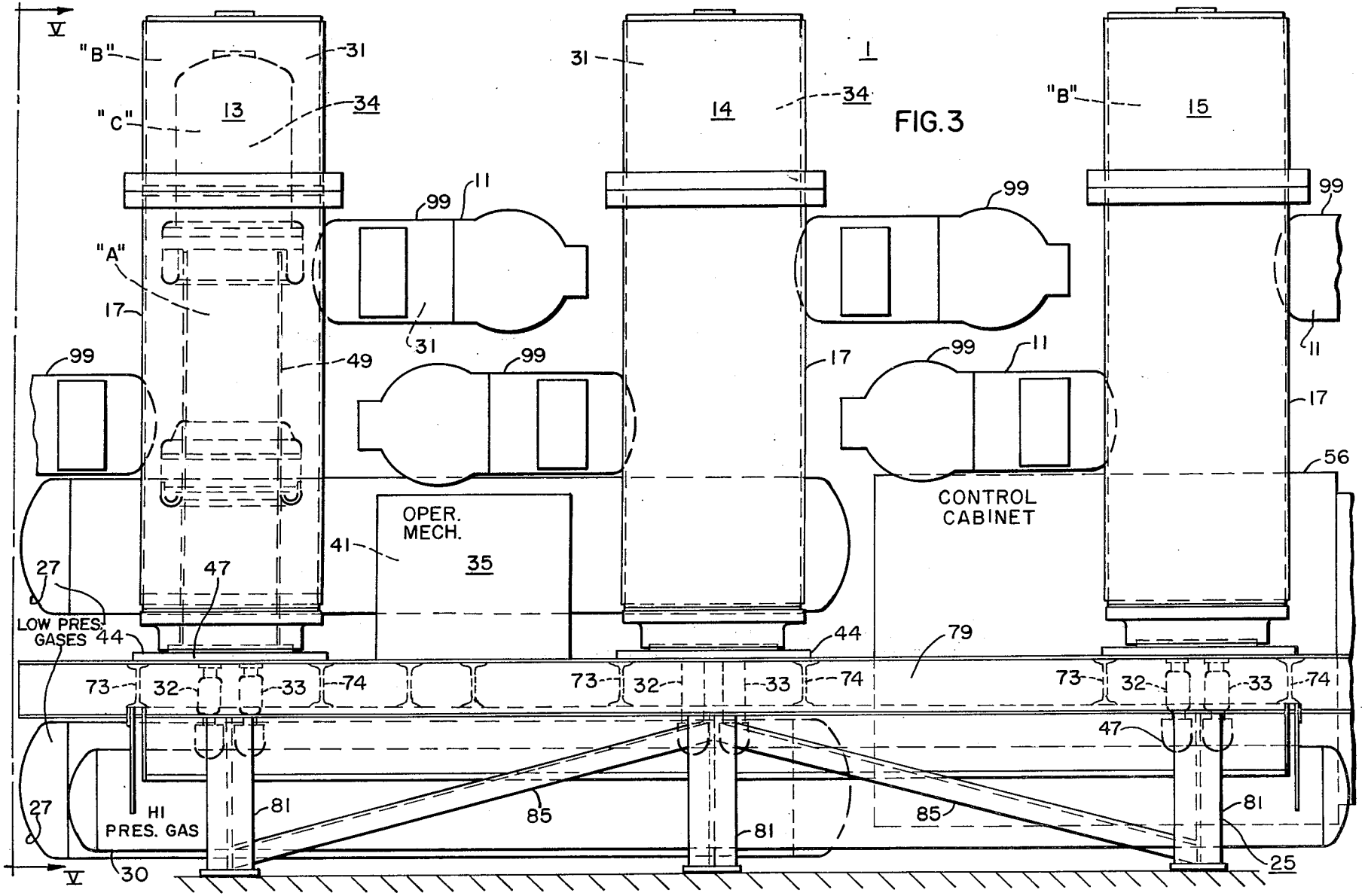
FIG. 3 is a side-elevational view of a three-phase multi-circuit-breaker power-transmission structure embodying the present invention.
Figure 4:
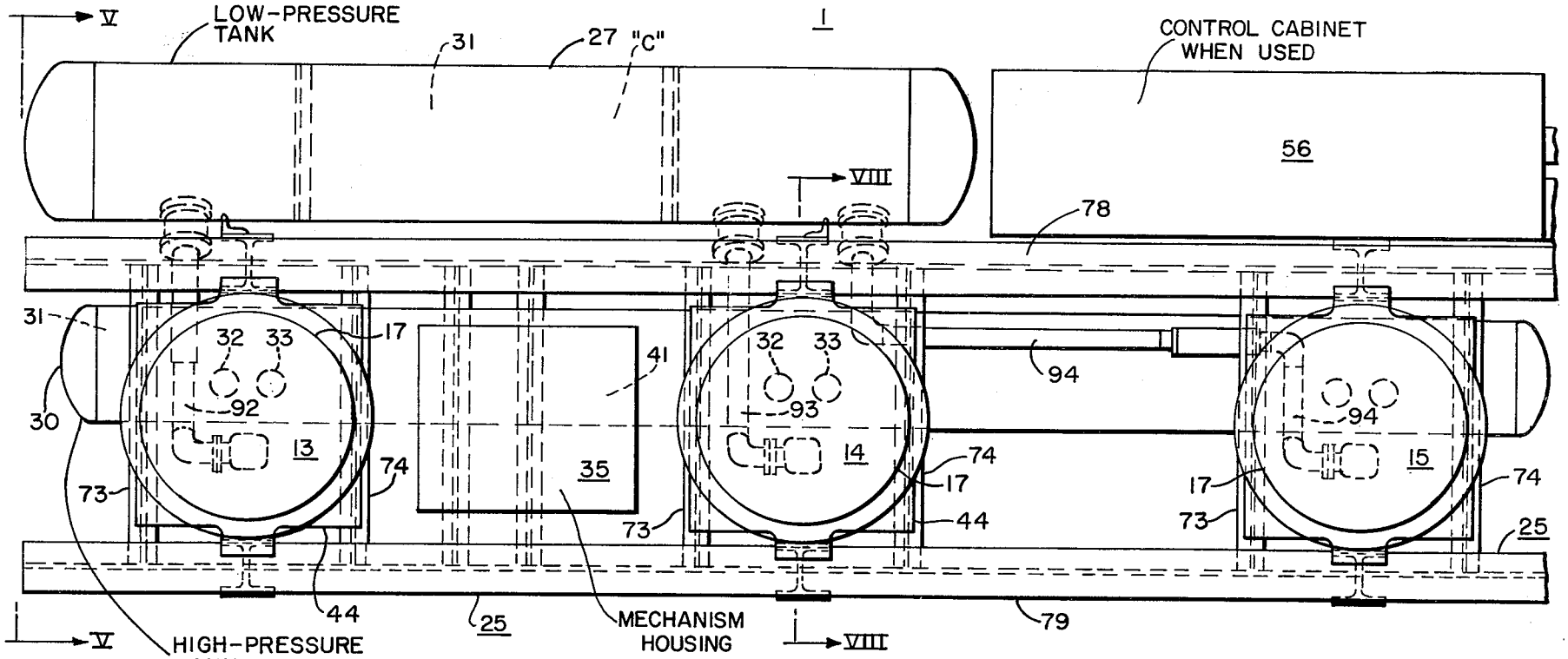
FIG. 4 is a top plan view looking downwardly upon the three-phase circuit-breaker installation of FIG. 3.

With reference to FIG. 3, it will be observed that there are provided three circuit-breaker assemblies, 13, 14 and 15, each including a casing structure 17, as more clearly illustrated in FIG. 4, enclosing separable contacts 19, 20 (FIG. 7), which are separable to an open position to establish arcing (not shown) and to effect circuit interruption. Reference may be made to the following United States patents for a detailed description of the individual circuit-interrupter assemblies 13, 14 and 15: U.S. Pat. Nos. 3,590,189, issued June 29, 1971; 3,596,028 — Kane et al issued July 27, 1971; 3,639,713 — Fischer et al issued Feb. 1,1972; 3,624,329 — Fischer et al issued Nov. 30, 1971 and 3,655,133 — Reese et al issued May 23, 1972.

The circuit-breaker assemblies 13, 14 and 15 are of high capacity and comprise three phase units mounted vertically upon a support frame 25. These breaker-modules use sulfur-hexafluoride ($SF_6$) gas 31 for arc-extinction, insulation and operation. The three vertical phase-units, or circuit-breaker assemblies 13, 14 and 15 are each mounted upon a base-plate 44. These base-plate 44 are supported by the boxed-in angle-type frame 25. Located on one side of the breaker-assembly 13 is a low-pressure gas-reservoir tank 27 containing $SF_6$ gas 31. This reservoir tank 27 has a dual function. During normal breaker operation, it contains sulfur-hexafluoride gas 31 at a nominal pressure of 10 p.s.i.g. This reservoir 27 is an ASME coded vessel. It has a relief valve attached to it which is set at 150 p.s.i.g.

The high-pressure reservoir tank 30 (FIG. 5) is located beneath the phase-units, or circuit-breaker assemblies 13, 14 and 15, and provides an adequate high-pressure gas supply. The reservoir tank 30 contains a heater, and heating of each interrupter assembly 13, 14 and 15 is by convection through two feed pipes 32, 33 (FIG. 4) from this reservoir 30. This reservoir 30 is ASME coded.

A compact weather-proof mechanism housing 35 is located between two phase units 13 and 14. This housing 35 contains the operating mechanism 41 (FIG. 6B) and associated auxiliary switches, which provide closing and tripping control for the breaker 1. The interrupter column 13, 14 or 15 each consists of an interrupter-module 23 housed within a grounded tank 17, and a high-voltage operator 34 at the top of the column, as shown in FIG. 7. The interrupter 23 is located in sulfur-hexafluoride gas region A at a nominal 245 p.s.i.g.

The interrupter 23 is arranged with the contacts 19, 20 surrounded by high-pressure $SF_6$ gas (region A) to give a minimum arcing time. On an opening operation, the operator 34 moves the movable interrupter contact 19 upwardly. As contact motion starts, the gas seal is broken at point x (FIG. 8A) to permit high-pressure $SF_6$ gas 31 in region A surrounding the contacts 19, 20, to start to flow radially inwardly through the hollow contact assembly. Contact overlap permits the moving contact 19 to attain the desired velocity and gas flow before contact part. Upon contact part, the arc 22 (FIG. 8B) is initially drawn between the stationary contact fingers 20 and the moving contact tip 19. Gas flow quickly transfers this arc 22 to the arcing tips resulting in a long arc, that is cooled and deionized by the inward flow of high-pressure $SF_6$ gas 31.

Near the end of the moving contact travel, the blast valve 37, 38 is actuated to close and to seal off the gas flow leaving the opened contacts 19, 20 (FIG. 8B) in an atmosphere of high-pressure $SF_6$ gas A. The total interrupting time from trip-coil energization to arc 22 (FIG. 8B) interruption is two cycles, or less.

The breaker 1 uses high-pressure gas (240 p.s.i.g.) for primary insulation to ground, insulation across the open contacts 19, 20, pressure differential for gas flow to the 10 p.s.i.g. system during arc interruption, and energy for breaker operation. $SF_6$ gas is used at an intermediate pressure of 45 p.s.i.g. for high dielectric strength in the area or region B (FIG. 7) immediately inside the grounded tank assembly 17. There is no $SF_6$ gas circulation between this insulation system B and the other two pressure systems A and low-pressure region C.

Sulfur-hexafluoride gas 31 in a pure state is inert and exhibits exceptional thermal stability. It has excellent arc-quenching properties. These characteristics, combined with its exceptionally good insulating properties, make it an excellent medium for use in circuit-breakers.

When the circuit-breaker 1 operates, it discharges gas from the high-pressure side A to the low-pressure side C, and raises the pressure to the low-pressure side C. The low-pressure governor switch actuates at 11 p.s.i.g. and completes the circuit of the line-starter coil to close the line-starter, energizing the compressor motor, and pumping the gas from the low-pressure side C to the high-pressure side A. After normal low pressure is reached (10 p.s.i.g.) the low-pressure governor switch opens to de-energize the line-starter and stop the compressor.

As mentioned, briefly, during the opening operation of each interrupter assembly 13, 14 or 15, the upper movable contact 19 moves upwardly away from the lower stationary contact 20, as illustrated in FIG. 7, establishing an arc therebetween, and effecting circuit interruption. Where desired, a movable isolator switch contact 39 of an isolator switch 99 (FIGS. 3 and 7) may be moved to the open and closed-circuit positions by suitable mechanism, constituting no part of the present invention, and the details of which may be obtained from a study of U.S. Pat. No. 3,700,840 — Wilson, and U.S. Pat. No. 3,694,592 — Kuhn.

Preferably a highly-insulating gas 31, such as sulfur-hexafluoride ($SF_6$) gas, is utilized throughout the gas system, through the isolator switch 99 (FIG. 3) and also within the circuit-interrupter assemblies 13, 14 and 15, as illustrated in FIG. 3.

Figure 5:
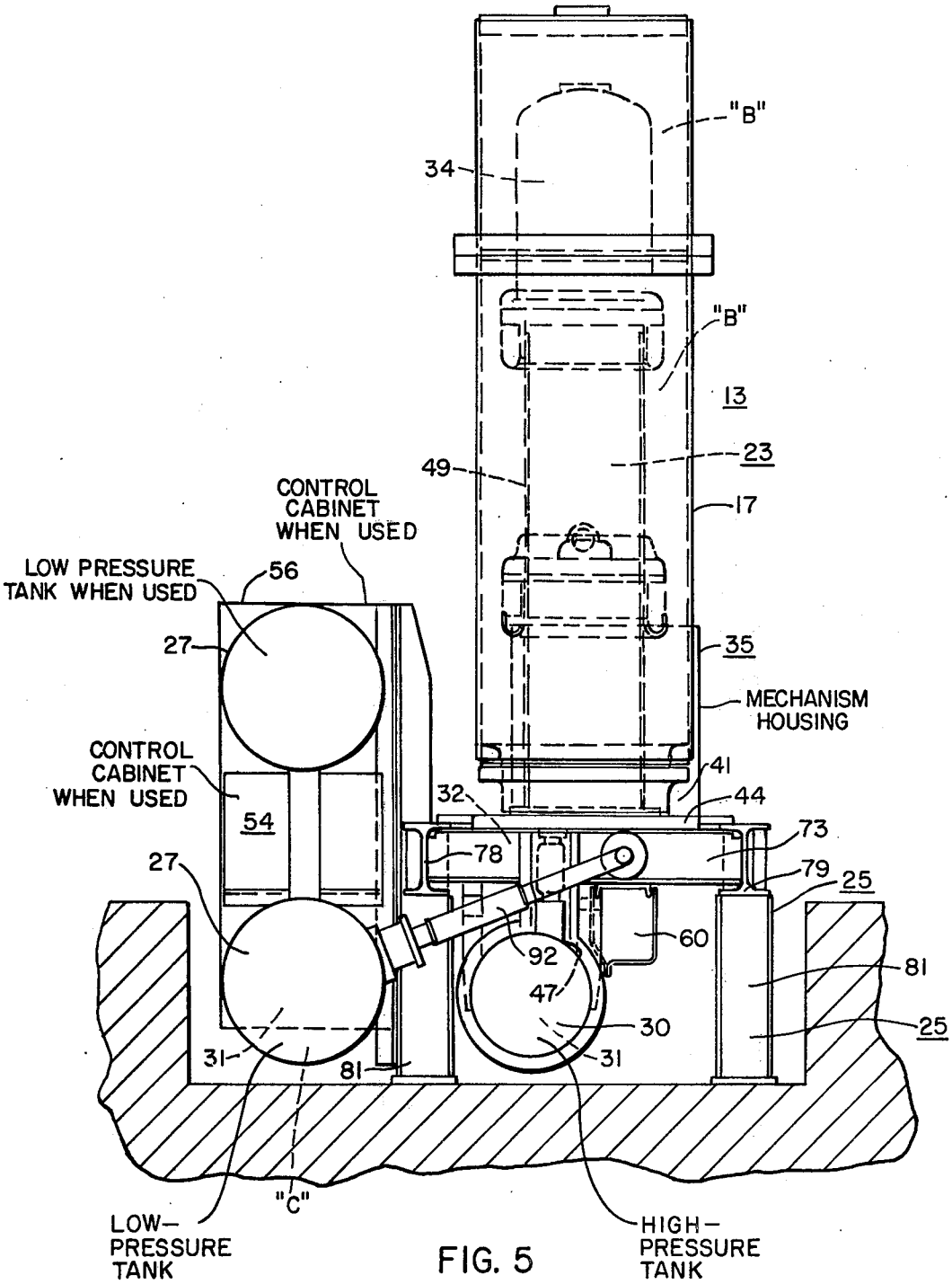
FIG. 5 is an end elevational view of the three-phase circuit-breaker installation of FIG. 3 taken along the line V—V of FIG. 4.

To provide the flow of high-pressure gas A upwardly into the three circuit-breaker assemblies 13, 14 and 15, a high-temperature inlet pipe 32 is provided for each assembly 13, 14 or 15, which terminates at the upper portion 47 (not illustrated) of the high-pressure reservoir tank 30, as shown more clearly in FIG. 5.

With reference to FIGS. 3–5 of the drawings, it will be observed that there are provided three upstanding circuit-breaker assemblies 13, 14 and 15, each of which has a contact structure 19, 20 more fully set forth in FIGS. 7 and 8 of the drawings. Generally, the movable contact structure 19 is actuated upwardly in a vertical direction by a suitable actuating piston structure (not shown) constituting a part of high-voltage operator 34, the latter constituting no part of the present invention, and the details of which are set forth in U.S. Pat. No. 3,639,713, to which reference may be made, and the teachings of which patent are incorporated herein by reference.

Figures 8A, 8B:
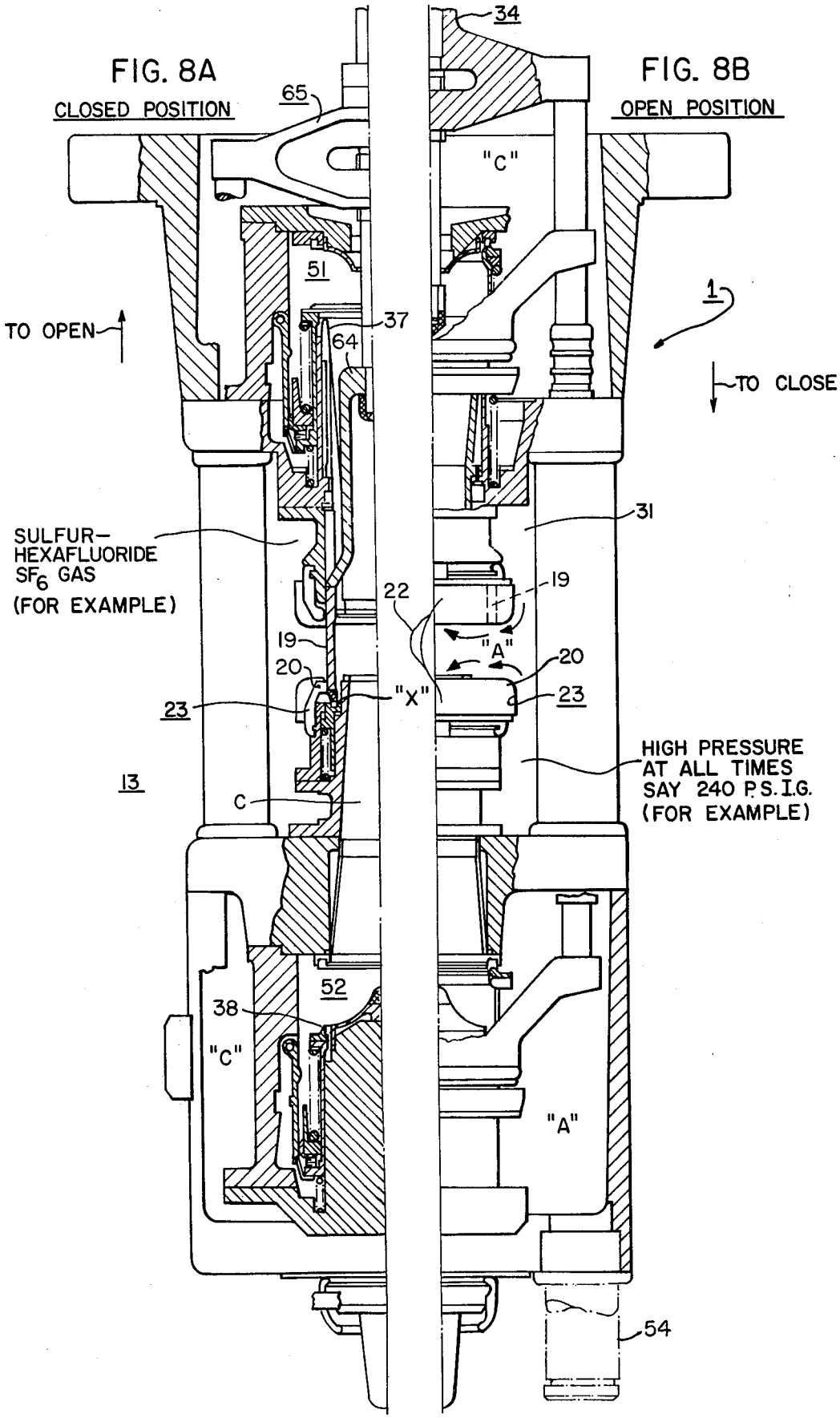

FIGS. 8A and 8B illustrate the contacts 19, 20 in both the closed and fully-open-circuit positions, and reference may be had to U.S. Pat. No. 3,596,028 issued July 27, 1971 to Richard E. Kane and Frank L. Reese in this connection.

The high-potential operator 34 is provided at the upper end of each of the circuit-breaker modules 23. An outer grounded casing housing 17 is provided, fabricated, for example, of aluminum. This entire casing 17 is grounded and contains for insulation purposes a highly-insulating gas 31, such as sulfur-hexafluoride ($SF_6$) gas, at a pressure, say, for example, 45 p.s.i.g. in region B.

The pressure A within the inner insulating casing 49 is at a much higher pressure, say, for example, 240 lbs./sq. inch. With reference to FIG. 8B, it will be observed that during the opening operation, gas flows radially inwardly between the separated contacts 19 and 20 and against the arc 22, and exhausts into expansion areas 51, 52 through secondary downstream blast-valves 37 and 38 to a low-pressure region C, which communicates by suitable conduit structure 54 (FIG. 7), to the low-pressure reservoir tank 27 of FIGS. 3 and 5. Suitable compressor equipment housed within cabinet 56 (FIG. 4) is utilized to effect a recompression of the low-pressure gas, and to store it at a higher pressure level within the high-pressure reservoir tank 30, illustrated more clearly in FIGS. 3 and 5 of the drawings.

Figure 6A:
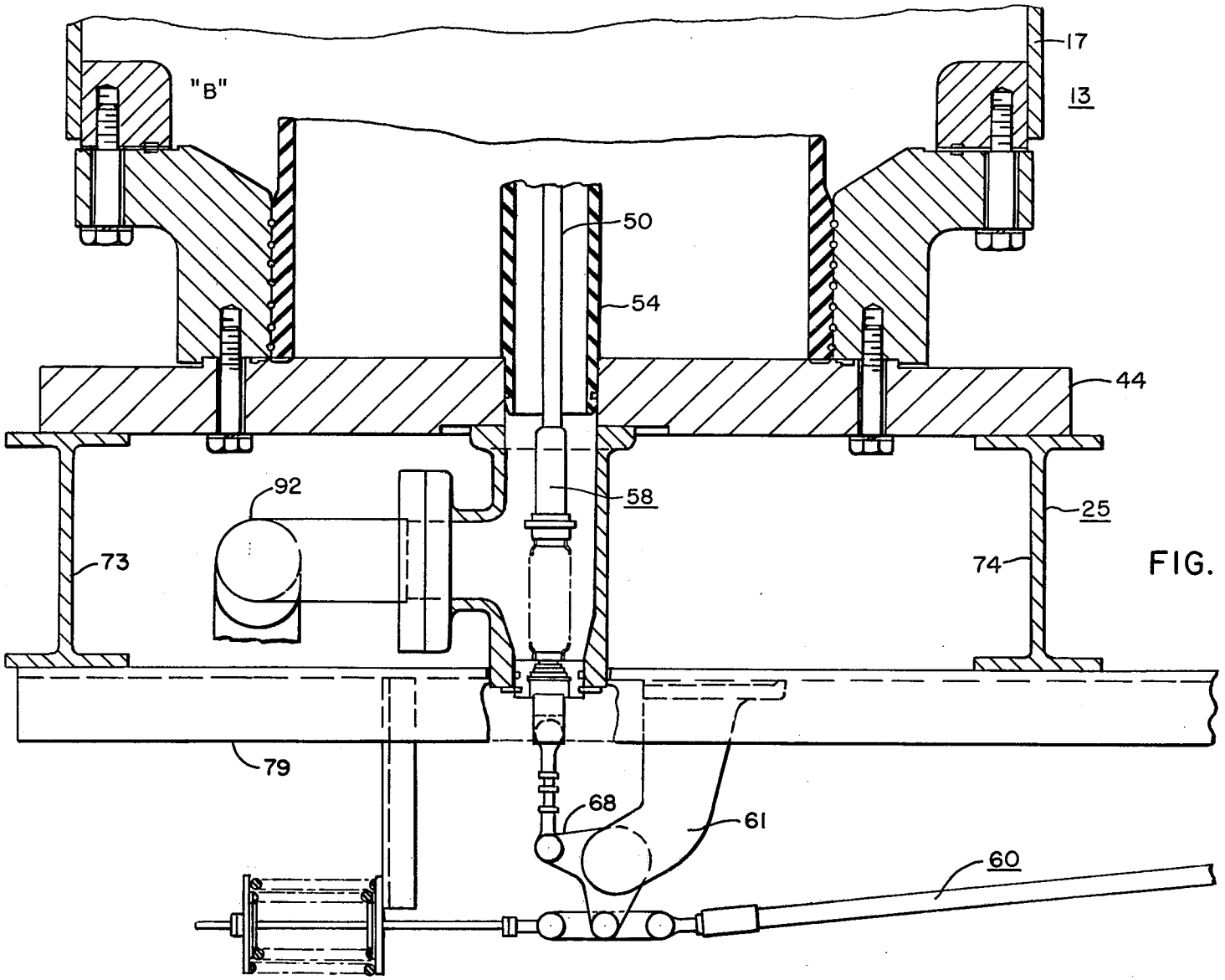
FIGS. 6A, 6B and 6C collectively show a fragmentary view illustrating the longitudinally-extending mechanical-linkage structure for actuating the several control-valves in the high-voltage operators of the individual circuit-breaker modules.
Figure 6B:
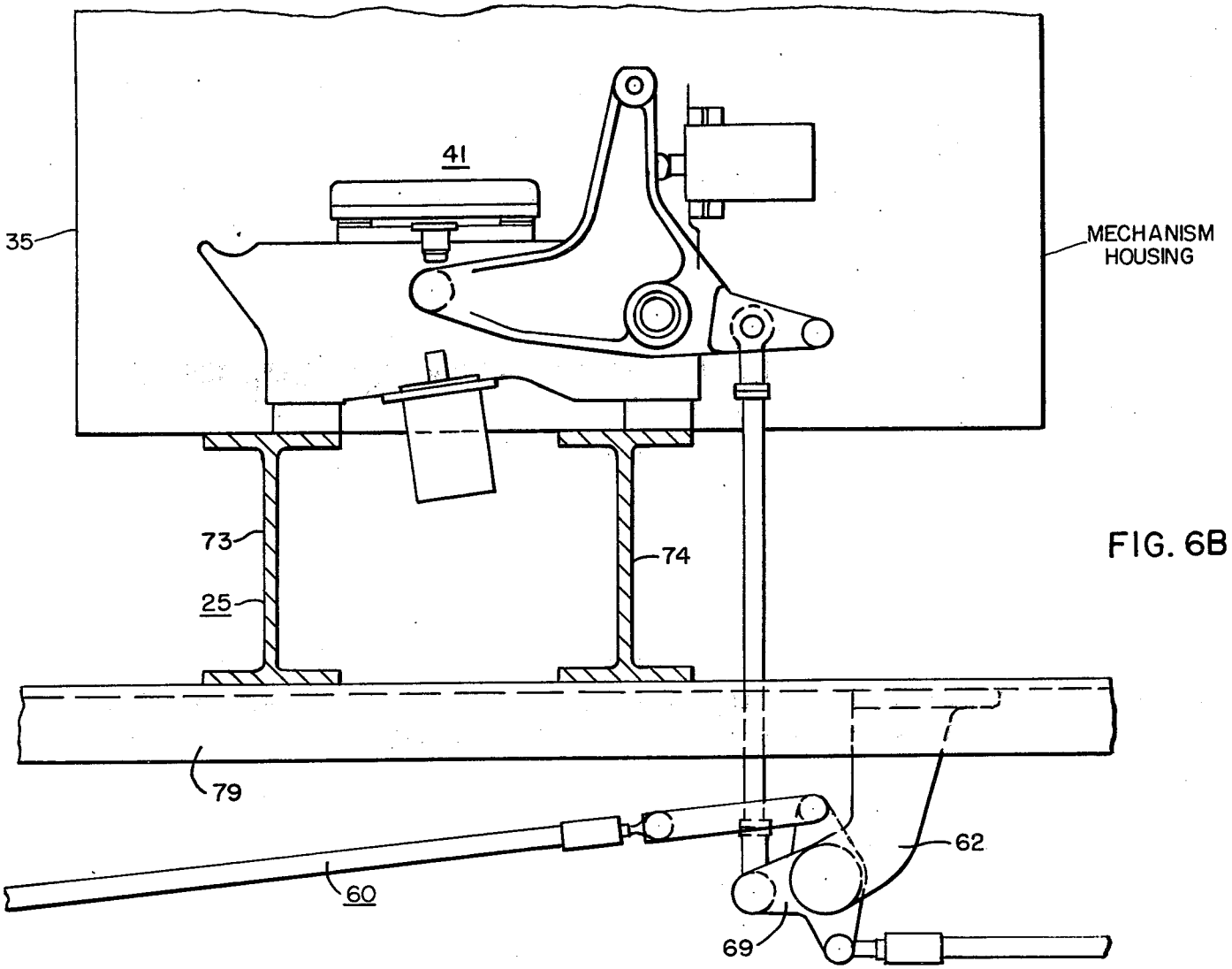
Figure 7:
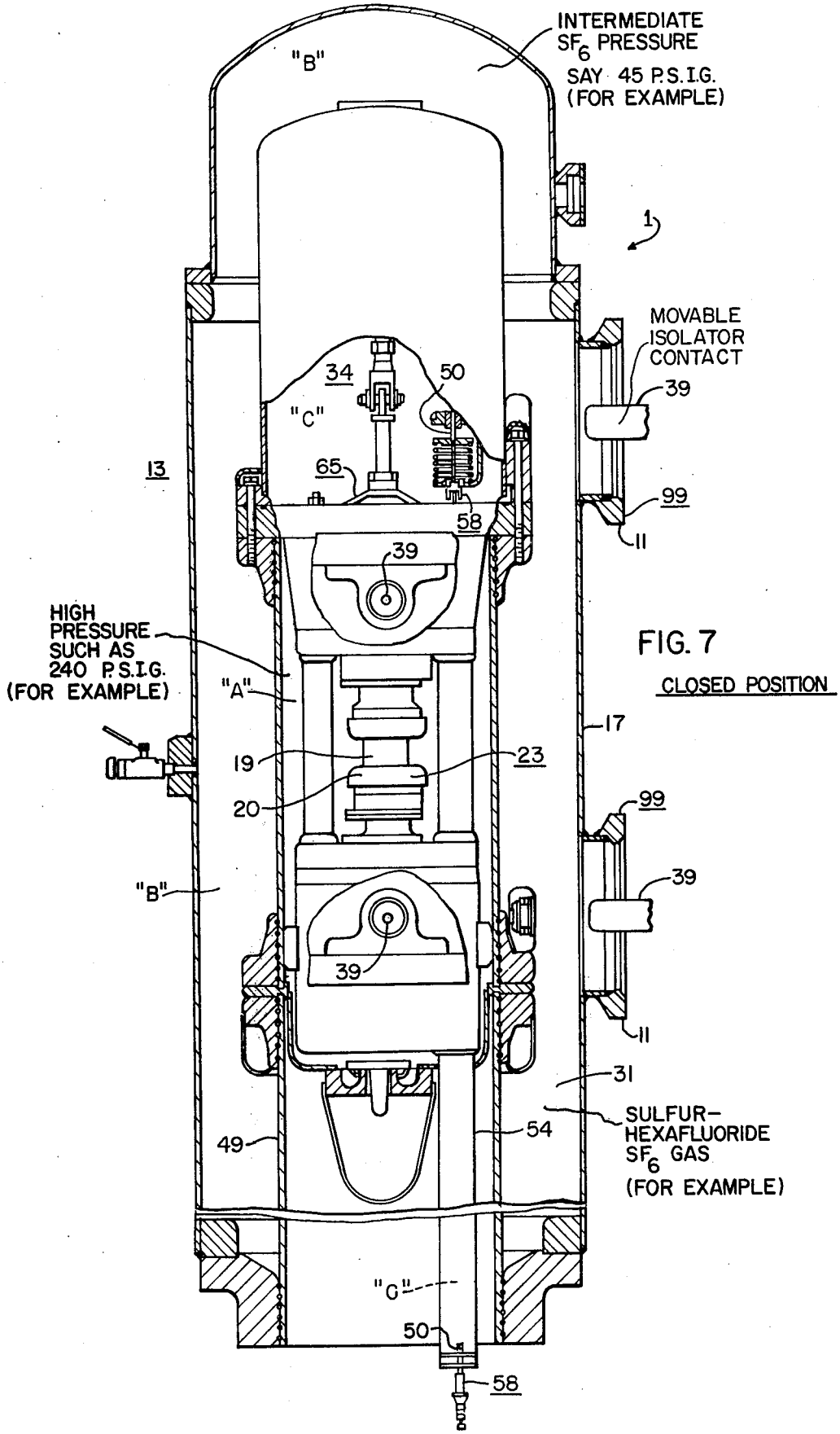
FIG. 7 is a vertical sectional view taken through one of the upstanding circuit-breaker assemblies of FIG. 3, with the separable contact structure of the interrupting module being illustrated in the closed-circuit position; and, FIGS. 8A and 8B show an enlarged view of the circuit-breaker module of FIG. 7, with the contacts shown in both the open and closed-circuit positions.

To effect simultaneous operation of the control-valve linkage 58 (FIG. 7) in each of the circuit-breaker modules 23, there is provided a longitudinally-extending generally-horizontally-arranged rod-linkage 60 (FIG. 6A) actuated by the generally-centrally-controlled ground-potential operator 41 (FIG. 6B). The rod-linkage 60 is guided through three guide supports 61, 62, and 63, and by means of bell-crank levers 68, 69 and 70 (FIGS. 6A-B-C) to effect vertical reciprocal movement of valve-control rods 50, one of which is provided for each of the three circuit-breaker modules 23. The valve-rods 50 extend upwardly into the high-potential operators 34 located in the upper end of the circuit-breaker module 23, as more clearly illustrated in FIG. 7.

The high-potential operator 34 includes a piston structure (not shown), which effects vertical opening and closing movements of a yoke structure, designated by the reference numeral 65 in FIG. 7. This is directly connected to the movable contact structure 19 by means of an actuating member 64 (FIG. 8A). The secondary blast-valves 37, 38 operate in a manner set forth in U.S. Pat. No. 3,665,133; consequently, their detailed functioning does not appear to be pertinent to the present invention, which is more concerned with the general overall circuit-breaker arrangement 1.

It will be noted, with reference to FIGS. 3 and 5, that the longitudinally-extending valve-rod linkage 60 is readily accessible for maintenance, and that the transverse rigid crossbeam structure 73, 74 is surmounted upon longitudinally-extending girder-type spaced I-beam supports 78 and 79 (FIG. 4). The high-pressure and low-pressure reservoir tanks 27, 30 extend longitudinally beneath the generally-rectangular-type I-beam frame structure 25, the circuit-breaker assemblies 13–15 seating upon base plates 44, which extend over the side I-beam supports 78 and 79. FIG. 5 shows this structure more clearly. Upstanding flanged steel I-beam legs 81 (FIG. 3) support the frame 25 and lateral braces 85 provide additional rigidity.

The connections to the upper and lower ends of the circuit-breaker modules 23 is effected by the gas-insulating piping or conduit structure 3, which, as well known by those skilled in the art, comprises an outer grounded metallic tank, or pipe 11 enclosing a centrally-disposed high-voltage conductor. A suitable gas, such as sulfur-hexafluoride ($SF_6$) gas 31, is provided, say at a pressure of 45 p.s.i.g. in region B. suitable isolating contacts 39 are provided to make electrical connection to the modules 23, as more clearly shown in FIG. 7 of the drawings.

From the foregoing description it will be apparent that the present invention is concerned with an overall structural mounting arrangement of the several component parts of a multiphase gas-type circuit-breaker installation 1. The various views show the unique arrangement of the several components so as to satisfy each component in its particular function, and to blend these components into a harmonious, or pleasing arrangement to serve the esthetic aspect. Specifically, the components are so arranged, such as the control cabinet 56, and low-pressure gas-reservoirs 27 on the same side of the breaker 1. Location of the reservoirs 27 is such as to permit additional cabinet space, if desired.

Orientation of the I-beam legs 81, location of the sulfur-hexafluoride gas-return lines 92, 93, 94 (FIG. 4) to the low-pressure reservoir 27 to best serve its function, and to permit easy access for servicing. Orientation of the mechanism components and horizontal valve-rod linkage 60 is such as to blend all of these components into a pleasing and functional arrangement. It will be noted that FIG. 5 shows the low-pressure gas-reservoirs 27 mounted on the same side of the circuit-breaker installation 1 along with the gas compressor and the control cabinet 56. See also FIG. 4 in this connection. This arrangement blends these components so as to give an overall esthetic touch of compactness to the entire installation.

Also, as illustrated in FIG. 4, the location of the low-pressure reservoirs 27 can be varied to allow for an additional cabinet for control, or some other function to be mounted above or below, or between the reservoirs 27. FIG. 5 shows the mounting and arrangement for an additional control cabinet 54, when desired, between the two reservoirs 27. Also, as shown in FIG. 5, indicating the end view, the I-beam legs 81 have been oriented to present maximum strength for the circuit-breaker 1 in the crosswise, or transverse direction.

Figure 6C:
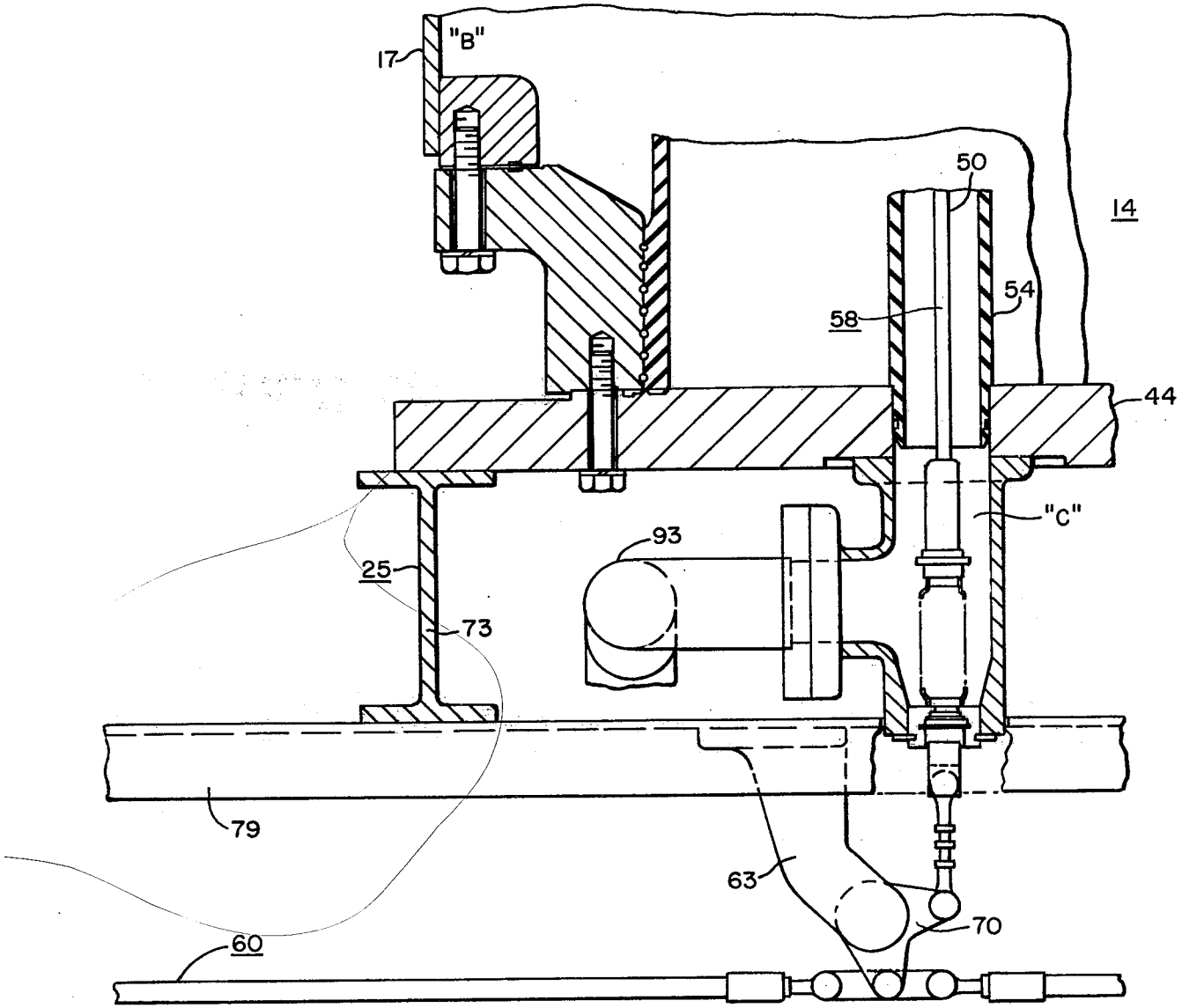

The arrangement of the I-beam legs 81 allows for increased strength crosswise with no bracing, and presents a pleasing flat appearance for the breaker side view. FIG. 5 is a more detailed enlargement of the end view showing the compactness of the component arrangement, and the accessibility of the sulfur-hexafluoride return lines 92–94 (FIG. 4). FIGS. 6A–6C show a more detailed sectional enlarged side view of the lower ends of the two poles 13 and 14. This view discloses the unique mechanismlever arrangement 68–70.

From the foregoing description of the invention it will be apparent that there has been provided an overall improved multi-phase circuit-breaker installation 1, utilizing the component parts in an advantageous manner to provide compactness and accessibility for each servicing for maintenance personnel. It will be noted, particularly, that the horizontal rod-linkage 60 causing the control-valve operation 58 is provided on one side of the breaker with easy access thereto for servicing by operating personnel. Also, it will be observed that the high-pressure and low-pressure reservoirs 27, 30 are disposed in such an arrangement that additional control cabinets, or other service housing units may be readily added, if desired. The connections to the spaced vertically-extending circuit-breaker modules 13–15 is such, as illustrated in FIGS. 3, 4, as to provide compactness and close spacing.

Although there has been illustrated and described a specific embodiment of the invention, it is to be clearly understood that the same was merely for the purpose of illustration, and that changes and modifications may readily be made therein by those skilled in the art, without departing from the spirit and scope of the invention.

What we claim is:

1. A multi-phase compressed-gas circuit-breaker installation comprising, in combination:

a. means defining a generally-rectangularly-shaped lower main metallic support frame;

b. upstanding metallic legs disposed at the corners of said generally-rectangularly-shaped lower main metallic support frame for supporting said rectangular support frame a predetermined distance above foundation level;

c. a plurality of laterally-spaced upstanding generally-cylindrically-shaped circuit-breaker assemblies (13,14) extending upwardly from and supported by said lower main rectangularly-shaped metallic support frame;

d. first line-terminal connecting means (39) for each circuit-breaker assembly disposed adjacent the upper end of the respective circuit-breaker assembly;

e. cooperable second line-terminal connecting means (39) disposed below the aforesaid first-mentioned first line-terminal connecting means (39) yet spaced upwardly from said main lower-disposed rectangularly-shaped metallic support frame;

f. pressure-operated separable power contact means for each circuit-breaker assembly disposed internally thereof and interposed between the respective pair of first and second line-terminal connecting means;

g. valve means provided for each circuit-breaker assembly for causing the actuation of the pressure-operated power contacts thereof and disposed internally thereof and also above said metallic support frame;

h. horizontally-extending valve-rod actuating linkage supported by said support frame and extending generally horizontally below the several circuit-breaker assemblies and mechanically interconnected with the several interiorly-disposed valve means for the respective circuit-breaker assemblies;

i. said valve-rod actuating linkage being disposed in the available space between the support frame and the foundation level;

j. a horizontally-extending high-pressure gas-reservoir extending lengthwise of the circuit-breaker assembly and supported by said support frame;

k. gas-conduit means interconnecting said high-pressure gas-reservoir tank and each circuit-breaker assembly;

l. an operating mechanism housing compartment disposed above the support frame and interposed between two adjacently-disposed circuit-breaker assemblies;

m. said mechanism compartment housing containing an operating mechanism for operating said horizontally-extending valve-rod linkage;

n. means providing at least one low-pressure gas-reservoir tank disposed rearwardly of the lower-disposed rectangularly-shaped frame support and extending generally horizontally; and, o. gas-conduit means interconnecting said horizontally-extending low-pressure gas-reservoir tank with each circuit-breaker assembly.

2. A compressed-gas multi-phase circuit-breaker assemblage comprising, in combination:

a. means defining a rectangularly-shaped table-like metallic heavy supporting framework;

b. said table-like heavy metallic supporting framework including a generally-rectangular angle-iron horizontal upper support frame (25) and at least four downwardly-extending corner leg supports (81);

c. a plurality of laterally-spaced upstanding generally-cylindrically-configured compressed-gas single phase circuit-breaker modules (13, 14, or 15) supported upwardly from said rectangular angle-iron horizontal upper support frame (25) in laterally-spaced relationship;

d. each of said single-phase compressed-gas modules having an upstanding gas-pressurized arc-extinguishing container disposed therewithin;

e. each gas-pressurized arc-extinguishing container having a pair of cooperable separable gas-operated power contacts disposed therewithin;

f. pneumatic operating means for each module for effecting the opening and closing movements of the respective arc-extinguishing container;

g. a pair of vertically-shaped line-terminal connecting means (39) for each single-phase compressed-gas module extending therefrom from adjacent the upper and lower ends thereof, and also electrically connected to the cooperable separable power contacts therewithin;

h. valve means for each module for operating the respective pneumatic operating mechanism for actuating the respective separable contact structure of the respective compressed-gas module;

i. said valve means being disposed internally of its respective module and also disposed above the support frame;

j. horizontally-extending valve rod-linkage means for simultaneously effecting the operation of the several valves for the several compressed-gas modules;

k. said horizontally-extending valve-rod linkage means (60) supported and guided by said heavy support framework (25), and positioned below the upper rectangular support frame (25);

l. a mechanism housing (35) containing an operating mechanism (41) and supported by said support frame above said upper support frame (25) and disposed between two adjacently-disposed compressed gas modules;

m. a longitudinally-extending high-pressure gas-reservoir tank supported by said heavy metallic framework, and disposed below the upper support frame (25) in general vertical alignment with the several laterally-spaced compressed-gas modules;

n. gas-conduit means extending upwardly from said longitudinally-extending horizontal high-pressure gas-reservoir tank into the several upper-disposed laterally-spaced gas-pressurized arc-extinguishing containers;

o. means defining a low-pressure gas-reservoir tank disposed to the external rear side of the supporting assemblage, supported by the heavy metallic framework and, additionally, extending generally horizontally and also longitudinally of the rectangularly-configured heavy framework; and, p. gas-conduit means pneumatically interconnecting the horizontally-extending low-pressure gas-reservoir tank with each compressed-gas module.

* * * * *